US005549463A

United States Patent [19]

Ozawa

[11] Patent Number: 5,549,463

[45] Date of Patent: Aug. 27, 1996

[54] COMPOSITE DRY VACUUM PUMP HAVING ROOTS AND SCREW ROTORS

[75] Inventor: Osamu Ozawa, Nagano-pref, Japan

[73] Assignee: Kashiyama Industry Co., Ltd., Tokyo, Japan

[21] Appl. No.: 398,441

[22] Filed: Mar. 3, 1995

[30] Foreign Application Priority Data

Nov. 24, 1994 [JP] Japan ..... 6-289822

[51] Int. Cl.[6] ..... F04C 23/00; F04C 25/02

[52] U.S. Cl. ..... 418/3; 418/9; 418/200

[58] Field of Search ..... 418/3, 9, 200

[56] References Cited

U.S. PATENT DOCUMENTS

| | | | |
|---|---|---|---|
| 1,626,768 | 5/1927 | Vollmann | 418/9 |
| 3,146,717 | 9/1964 | Tyree, Jr. | 418/3 |
| 3,182,670 | 5/1965 | Howell | 417/396 |
| 4,504,201 | 3/1985 | Wycliffe | 418/3 |
| 5,011,520 | 4/1991 | Carr et al. | 55/228 |
| 5,158,644 | 10/1992 | Cheung et al. | 156/643 |
| 5,197,861 | 3/1993 | Maruyama et al. | 418/201.1 |
| 5,295,798 | 3/1994 | Maruyama et al. | 418/201.1 |
| 5,302,089 | 4/1994 | Maruyama et al. | 417/205 |
| 5,348,448 | 9/1994 | Ikemoto et al. | 417/203 |
| 5,352,097 | 10/1994 | Itou et al. | 417/203 |
| 5,443,644 | 8/1995 | Ozawa | 418/201.1 |

FOREIGN PATENT DOCUMENTS

| | | | |
|---|---|---|---|
| 1-237384 | 9/1989 | Japan | 418/3 |
| 3-111690 | 5/1991 | Japan | 418/9 |
| 4-71522 | 7/1994 | Japan . | |
| 840414 | 6/1981 | U.S.S.R. | 418/3 |

*Primary Examiner*—John J. Vrablik

*Attorney, Agent, or Firm*—Burns, Doane, Swecker & Mathis, L.L.P.

[57] ABSTRACT

A composite dry vacuum pump of this invention has closed chambers accommodating a pair of screw rotors and a pair of roots rotors respectively mounted coaxially to the front ends of the screw rotors. The roots rotors and the screw rotors are rotated at the same speed in opposite directions by a motor to aspirate fluids from a suction port on one end wall and discharge the fluid through a discharge port on the outer surface of the other end wall. The characteristics of power requirement of the portion of the roots rotors and that of the portion of the screw rotors changes inversely to the suction port pressure variation, therefore the characteristic of the total power requirement of the pump of this invention is almost flat over the all pressure range and the motor having smaller output power can operate the pump according to the present invention. Furthermore, the pump of this invention having the roots rotors coaxially assembled on the front end of the screw rotors makes a device containing this pump more compact one.

1 Claim, 4 Drawing Sheets

COMPOSITE DRY VACUUM PUMP HAVING ROOTS AND SCREW ROTORS

BACKGROUND OF THE INVENTION

1. Field of the Invention

The present invention relates to a vacuum dry pump for evacuating a reaction chamber of a semiconductor-manufacturing device and the like or for discharging gaseous material generated in the reaction chamber.

2. Prior Art Description

The roots pump is one type of vacuum dry pumps and widely used as a booster pump since it has a characteristic that, in a low operating pressure, its discharging speed is higher while its power requirement is smaller. As shown in FIG. 6, for example, a multistage pump system comprising a roots pump 100 installed at vacuum side and an oil rotary pump or dry pump 200 installed at ambient side is used for evacuating the reaction chamber of a semiconductor-manufacturing device and the like to make a high vacuum condition therein.

FIG. 7 shows a typical characteristic curve of discharging speed of the roots pump and that of the oil rotary pump or dry pump. As is shown by these characteristic curves, the discharging speed of the roots pump is higher than that of the oil rotary pump or dry pump which is an ambient-side primary pump. Due to such difference of the discharging speeds in the system of FIG. 6, an over pressure condition may occur in the roots pump, which increases the power requirement of the roots pump when its operating pressure is near the ambient condition. To reduce the power requirement, in such case, the roots pump should be stopped or its rotational speed should be lowered.

It is preferable that the property of the power requirement of the pump and/or the pump system should be almost flat even if their suction pressure varies. However, according to the characteristics of the power requirement of the oil rotary pump or the dry pump that have conventionally been used with the roots pump, their power requirement also tends to become large with increasing of the suction pressure toward the ambient condition. Therefore, it is also impossible to suppress their power requirement change.

On the other hand, if the conventional multistage pump system of FIG. 6 is used to obtain a high compression ratio (a high degree of vacuum), the conventional system has another problem that it requires a large space for installation and cannot be made compact.

A main object of the present invention is, taking the aforementioned problems into consideration, to provide a composite dry vacuum pump wherein the power requirement change is small and the structure is so compact.

SUMMARY OF THE INVENTION

In order to achieve the above and other objects, the inventor of the present invention, paying attention to a power requirement property of a screw rotor pump that the applicant of this application proposed by Japanese Utility Model Applications Nos. Hei 4-71521 and Hei 4-71522, and has made a novel composite dry vacuum pomp of this invention that acquires little change in power requirement and compact structure by connecting a screw rotor and a roots rotor coaxially.

The composite dry vacuum pump according to the present invention has the following structures (a) to (m):

(a) a first closed chamber and a second closed chamber separated by a partition wall;

(b) a first screw rotor accommodated in said first closed chamber and formed on the circumferential surface with rectangular-shaped screws at equal leads;

(c) a second screw rotor accommodated in said first closed chamber and formed on the circumferential surface with rectangular-shaped screws at equal leads so as to mesh with said rectangular-shaped screws of said first screw rotor;

(d) front end shaft portions of said first and second screw rotors respectively extended coaxially from front ends of said first and second rotors into said second closed chamber through said partition wall;

(e) first and second roots rotors respectively fixedly mounted on said front end shaft portions of said first and second rotors;

(f) rear end shaft portions of said first and second screw rotors respectively extended coaxially from rear ends of said first and second rotors through a end wall of said first closed chamber;

(g) a drive motor for rotating said first and second screw rotors;

(h) a power transmission mechanism for transmitting rotation force of said drive motor to said screw rotors respectively so that said first and second screw rotors rotate at a same speed in opposite directions;

(i) a bearing mechanism for supporting said front end shaft portions of said first and second rotors rotatively to said partition wall;

(j) a bearing mechanism for supporting said rear end shaft portions of said first and second rotors rotatively to said end wall of said first closed chamber;

(k) a suction port arranged on a end wall of said second closed chamber and communicated with said second closed chamber internal;

(l) a connecting hole arranged on said partition wall for connecting said first and second closed chambers; and (m) a discharge port arranged on said end wall of said first closed chamber and communicated with said first closed chamber internal.

In the composite dry vacuum pump of the present invention, a roots pump is constituted on the vacuum-side and a screw pump is constituted on the ambient-side. According to the characteristic of the roots pump, its power requirement is higher if the operating pressure is near the ambient condition while the power requirement is lower if the operating pressure is near the vacuum condition, On the other hand, according to the characteristic of the screw pump, its power requirement is lower if the operating pressure is near the ambient condition while the power requirement is higher if the operating pressure is near the vacuum condition. Hence, as a total characteristic of the present composite dry vacuum pump, its power requirement property is almost flat in all the operating pressure and the variation of the power requirement is suppressed to the suction pressure change.

In addition, in the composite dry vacuum pump of the present invention, the roots rotors are assembled coaxially on the extended front ends of a pair of screw rotors. Owing to such structure, the pump of the present invention obtains compact size compared to the multistage pump system constructed by the combination of individual and different type pumps.

BRIEF DESCRIPTION OF THE DRAWINGS

These and other objects and features of the present invention will become clear from the following description taken in conjunction with the preferred embodiment thereof with reference to the accompanying drawings, in which.

DETAILED DESCRIPTION OF THE PREFERRED EMBODIMENT

The preferred embodiment Of the present invention will be described below with reference to the attached drawings.

Figure 1:
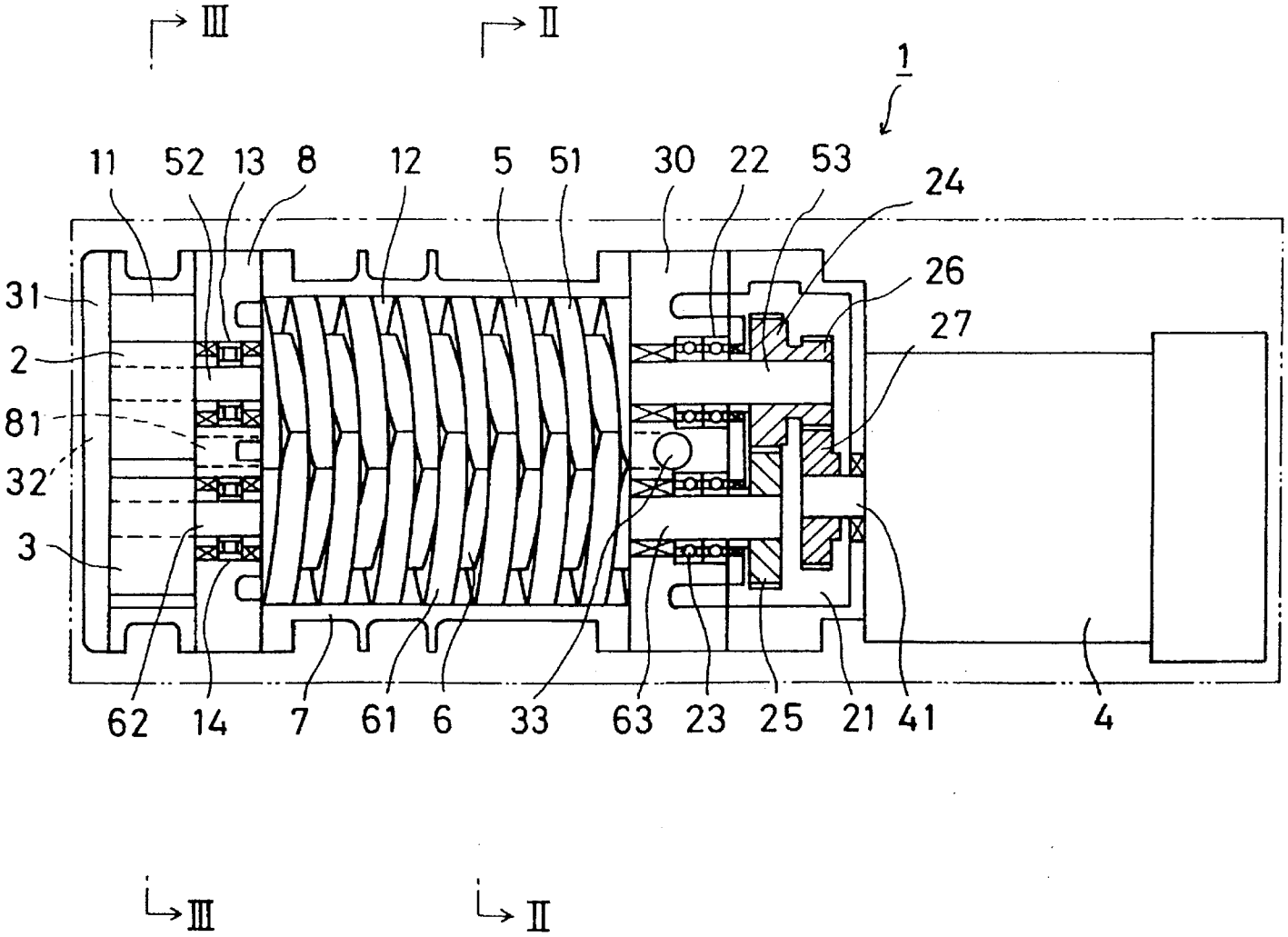
FIG. 1 is a schematic sectional view showing a constitution of a composite dry vacuum pump according to an embodiment of the present invention.

FIG. 1 illustrates main elements of the composite dry vacuum pump of a preferred embodiment according to the present invention. The composite dry vacuum pump 1 of this embodiment has a pair of roots rotors 2 and 3 at its front end side, a drive motor 4 at its rear end side, and a pair of screw rotors 5 and 6 between the drive motor 4 and the roots rotors 2 and 3. The each screw rotor 5 and 6 are coaxially fixed on the roots rotors 2 and 3 respectively.

Figure 2:
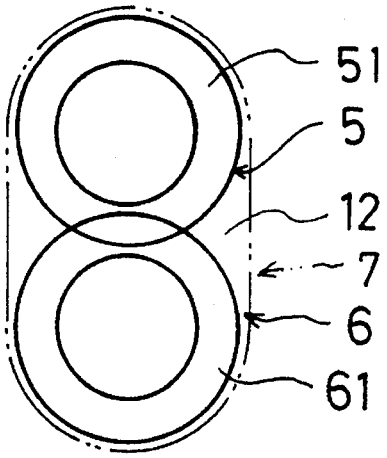
FIG. 2 is a sectional view showing a screw rotor portion of the pump in FIG. 1.

In more detail, the composite vacuum pump 1 has a pump casing 7 in which a vacuum-side closed chamber 11 and an ambient-side closed chamber 12 are defined at a respective side of a partition wall 8. Inside the ambient-side closed chamber 12, a pair of the screw rotors 5 and 6 are arranged in parallel. The screw rotors 5 and 6 comprise rectangular-shaped screws 51 and 61 spirally formed on their circumferential surfaces at equal lead, respectively. The front ends of these screw rotors 5 and 6 extend into the vacuum-side closed chamber 11 through the partition wall 8, respectively. The portions penetrating the partition wall 8 are supported rotatively by bearings 13 and 14, respectively. Seals are attached on both sides of these bearings 13 and 14 to seal up a space between the closed chamber 11 and 12. FIG. 2 is a sectional view of the closed chamber 12.

Figure 3:
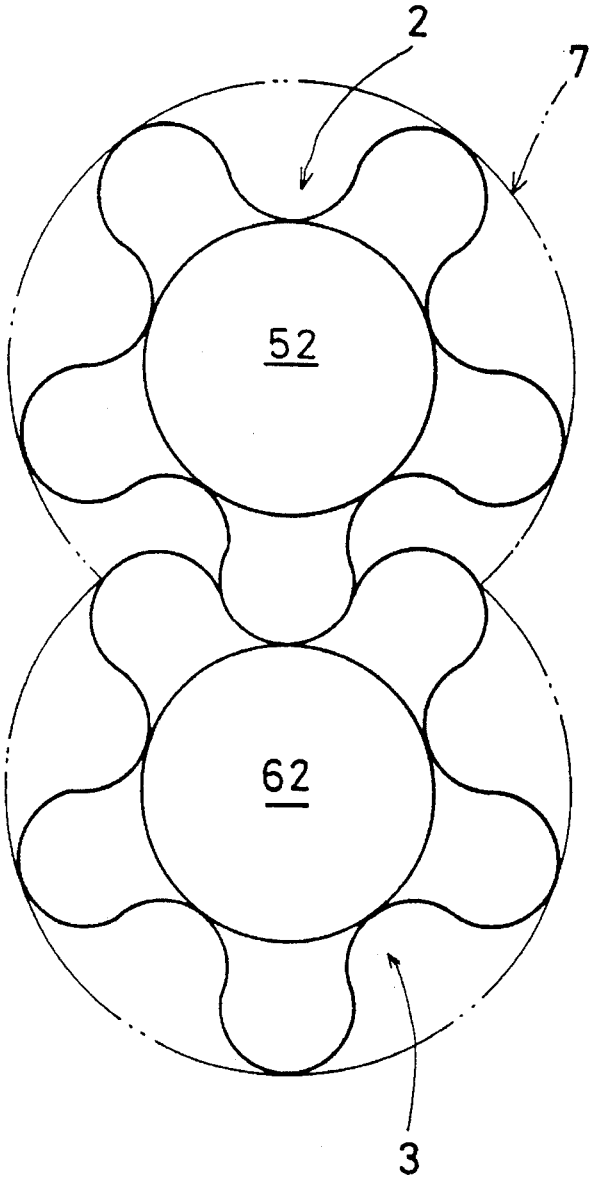
FIG. 3 is a sectional view showing a roots rotor portion of the pump in FIG. 1.

The roots rotors 2 and 3 are fixedly mounted around front end shaft portions 52 and 62 of the screw rotors 5 and 6 extending into the vacuum-side closed chamber 11, respectively. FIG. 3 shows the sectional shape of the closed chamber 12 of this embodiment together with the outer circumferential profiles of the roots rotors 2 and 3. As shown in FIG. 3, the roots rotors 2 and 3 of this embodiment have quincunxes' shape. The rotors may have triphyllous shape or the like.

Rear ends of the screw rotors 5 and 6 penetrate an end wall 30 of the closed chamber 12 and extend into a gear chamber 21. The rear end shaft portions 53 and 63 of the screw rotors 5 and 6 are supported rotatively by bearings 22 and 23 arranged on the end wall 30, respectively. The bearings 22 and 23 have seals for closing up the chamber 12. An idle gear 24 is fixed on the rear end shaft portion 53 of the screw rotor 5 extending into the gear chamber 21, which meshes with a timing gear 25 fixed on the rear end shaft portion 63 of the other screw rotor 6. The idle gear 24 has a follower gear 26 integrally formed thereto that meshes with a drive gear 27 fixed on an output shaft 41 of the motor 4 projecting inside the gear chamber 21. In this embodiment, the screw rotors 5 and 6 rotate at the same speed in opposite directions via the above-mentioned gear train. The roots rotors 2 and 3 assembled on the front end shaft portions 52 and 62 of the screw rotors 5 and 6 also rotate at the same speed in opposite directions.

The composite dry vacuum pump of this embodiment also has a suction port 32 arranged on an end wall 31 of the vacuum-side closed chamber 11, a connecting port 81 arranged on the partition wall 8 for communicating the closed chamber 11 with the ambient-side closed chamber 12, and a connecting port 33 arranged on the end wall 30 of the ambient-side closed chamber 12 for communicating with a discharging port (not illustrated) on the outer surface of the end wall 30. By the suction port 32, the closed chamber 11, the connecting port 81, the closed chamber 12, the connecting port 33 and the discharging port, an evacuating route from the suction side to the discharge side is formed.

As described above, the composite dry vacuum pump 1 of this embodiment comprises a roots pump mechanism on the vacuum-side and a screw pump mechanism on the ambient-side. In addition, these mechanisms are arranged coaxially on the same rotors of the pump. Therefore, when the motor 4 is driven, a pair of the screw rotors 5 and 6, and a pair of the roots rotors 2 and 3 rotate at the same speed in opposite directions to discharge fluids such as the air, inhaled from the suction port 32, to the atmosphere through the gas discharging port. For instance, when the pump 1 is in operation after its suction port 32 is connected to the reaction chamber of a semiconductor-manufacturing device, the reaction chamber becomes a high vacuum condition.

Figure 4:
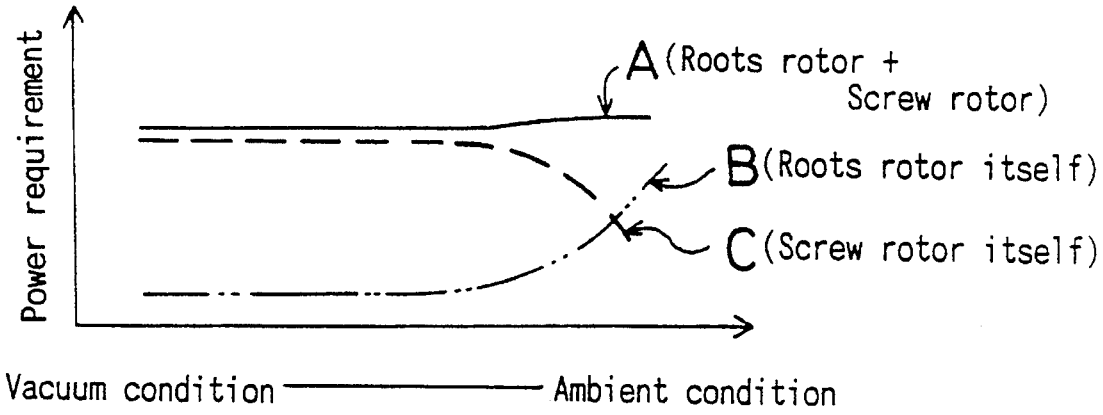
FIG. 4 shows a characteristic curve of a power requirement property of the pump in FIG. 1.

FIG. 4 shows the characteristics of power requirement of the pump 1 of this embodiment. The characteristic curve A shows the power requirement (electric power consumption ) of the pump of this embodiment and it is almost flat irrespective of the suction port pressure variation. In detail, the curve B of this figure shows that the power requirement of the roots pump itself and the power requirement becomes large with increasing of the suction port pressure toward the ambient pressure. However, the power requirement property of the screw rotor pump itself indicated as a curve C in the same figure, has another characteristic to the curve B and the power requirement becomes small with increasing of the suction port pressure toward the ambient pressure. The reason of such property of the screw pump is that the screw rotor pump does not compress fluids therein so that its power requirement decreases when the suction port pressure rises up toward the ambient condition, while its power requirement increases when the suction port pressure falls toward the vacuum condition. That is to say, a torque is generated at the screw rotor in response to a lead angle of the rectangular threads, and it becomes large with increasing of the stress applied to the rectangular thread owing to a pressure difference to the discharging port. And according to the generated torque, the power requirement of the screw pump increases. As a result, since the pump 1 of this embodiment has a composite construction of the above pump mechanisms, its property of power requirement becomes almost flat in the all the operating pressure as shown in the curve A.

Figure 5:
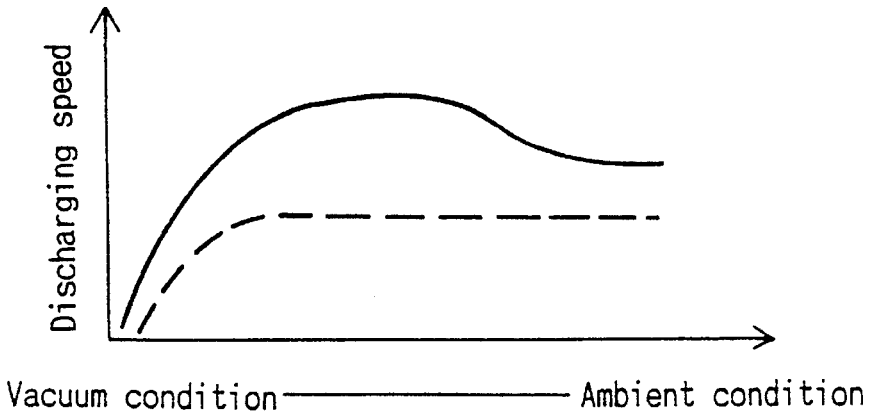
FIG. 5 shows a characteristic curve of a gas discharging speed property of the pump in FIG. 1.
Figure 6:
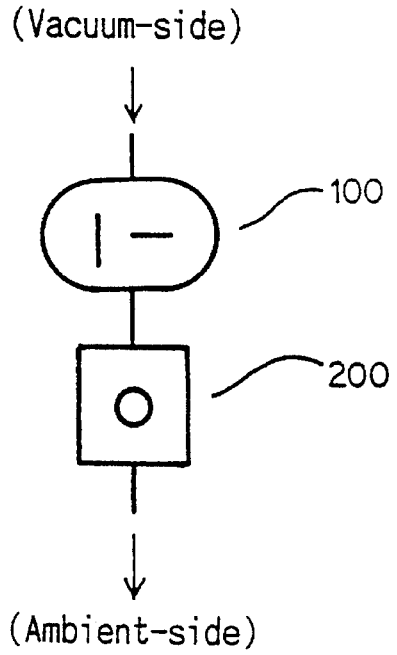
Figure 6 (PRIOR ART)
FIG. 6 is a schematic diagram showing a conventional multistage dry vacuum pump system.
Figure 7:
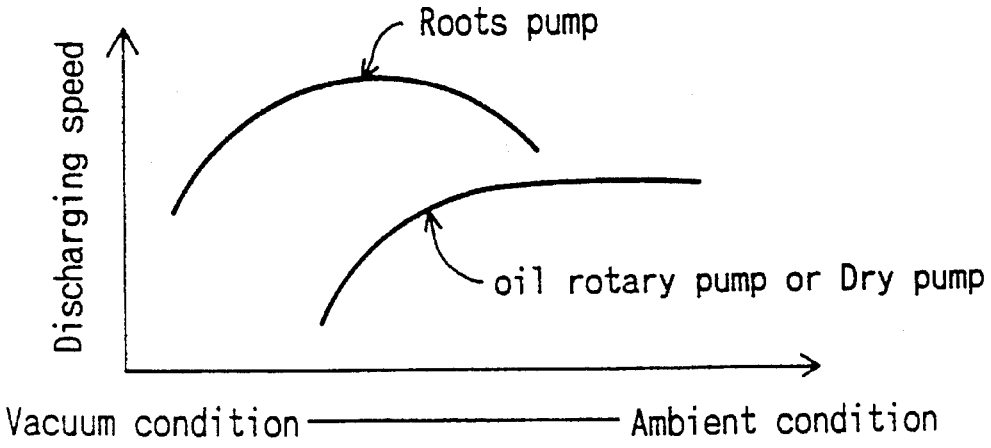
Figure 7 (PRIOR ART)
FIG. 7 shows characteristic curves of gas discharging speed properties of the pumps in FIG. 6.

FIG. 5 illustrates a gas discharging speed property of the pump 1 of this embodiment by a solid line together with that of the screw pump itself by a dotted line.

As is clear from the aforementioned explanation, In the pump of the present, different from the conventional multistage pump system, the over pressurized condition may not occur. In addition, because the power requirement of the pump of this invention is almost constant in all operating pressure range, the required motor output power can be reduced. In other words, a motor having smaller capability can be adopted for driving the pump of this invention.

The pump of the present invention has the another advantage that it arranges a pair of roots rotors to be mounted coaxially on the front end of a pair of screw rotors, respectively. Therefore, the pump of this invention itself, and also devices composing the pump can be constituted more compact than the conventional pump system composed of the combination of two different type pumps.

As explained in detail, the composite dry vacuum pump according to the present invention has a pair of screw rotors and a pair of roots rotors assembled coaxially on the front ends of the screw rotors, respectively. Hence, the pump of the present invention enables its power requirement characteristics almost flat irrespective to the suction port pressure variation so that the motor having smaller output power can operate the pump of this invention. In addition, using the pump of the present invention makes the whole device compact.

Although the present invention has been fully described in connection with the preferred embodiment thereof with reference to the accompanying drawings, it is to be noted that various changes and modifications are apparent to those skilled in the art. Such changes and modification are to be understood as included within the scope of the present invention as defined by the attached claim unless they depart therefrom.

What is claimed is:

1. A composite dry vacuum pump comprising:

a first closed chamber defining a screw pump and a second closed chamber defining a roots pump;

a partition wall separating the first closed chamber and the second closed chamber;

a first screw rotor accommodated in said first closed chamber and formed on its circumferential surface with rectangular-shaped screws at equal leads;

a second screw rotor accommodated in said first closed chamber and formed on its circumferential surface with rectangular-shaped screws at equal leads so as to mesh with said rectangular-shaped screws of said first screw rotor;

front end shaft portions of said first and second screw rotors respectively extended coaxially from front ends of said first and second rotors into said second closed chamber through said partition wall;

first and second roots rotors respectively fixedly mounted on said front end shaft portions of said first and second rotors;

rear end shaft portions of said first and second screw rotors respectively extended coaxially from rear ends of said first and second rotors through a end wall of said first closed chamber;

a drive motor for rotating said first and second screw rotors;

a power transmission mechanism for transmitting rotation force of said drive motor to said screw rotors respectively so that said first and second screw rotors rotate at a same speed in opposite directions;

a bearing mechanism for supporting said front end shaft portions of said first and second rotors rotatively to said partition wall;

a bearing mechanism for supporting said rear end shaft portions of said first and second rotors rotatively to said end wall of said first closed chamber;

a suction port arranged on an end wall of said second closed chamber and communicated with said second closed chamber internal;

a connecting hole arranged on said partition wall for connecting said first and second closed chambers; and a discharge port arranged on said end wall of said first closed chamber and communicated with said first closed chamber internal.

* * * * *